US011175026B1

(12) United States Patent
Yu et al.

(10) Patent No.: US 11,175,026 B1
(45) Date of Patent: Nov. 16, 2021

(54) TRACK ELECTRONIC APPARATUS

(71) Applicant: XIAMEN LEEDARSON LIGHTING CO., LTD, Fujian (CN)

(72) Inventors: Yuanbin Yu, Fujian (CN); Jinhua Xie, Fujian (CN); Zuanchao Zheng, Fujian (CN); Liangliang Cao, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 16/926,638

(22) Filed: Jul. 10, 2020

Related U.S. Application Data

(60) Provisional application No. 63/041,826, filed on Jun. 20, 2020.

(51) Int. Cl.
*F21V 21/35* (2006.01)
*F21V 23/06* (2006.01)
*F21V 21/088* (2006.01)

(52) U.S. Cl.
CPC ..... *F21V 21/35* (2013.01); *F21V 21/088* (2013.01); *F21V 23/06* (2013.01)

(58) Field of Classification Search
CPC ..... F21V 21/35; F21V 21/088; F21V 23/06; F21V 21/005; F21V 21/30; F21V 19/02; F21V 21/34
See application file for complete search history.

(56) References Cited

U.S. PATENT DOCUMENTS

| | | | | |
|---|---|---|---|---|
| 5,672,003 | A * | 9/1997 | Shemitz | F21S 2/00 248/214 |
| 6,004,005 | A * | 12/1999 | Demshki, Jr. | F21S 8/038 362/147 |
| 7,513,675 | B2 * | 4/2009 | Mier-Langner | F21S 8/038 362/147 |
| 9,291,338 | B2 * | 3/2016 | Liu | F21S 2/00 |
| 10,670,240 | B2 * | 6/2020 | Shih | F21V 23/003 |
| 10,788,191 | B1 * | 9/2020 | Berry | F21V 21/35 |
| 2015/0159840 | A1 * | 6/2015 | Liu | F21S 2/00 362/648 |

* cited by examiner

*Primary Examiner* — Peggy A Neils
(74) *Attorney, Agent, or Firm* — Chun-Ming Shih; Lanway IPR Services

(57) ABSTRACT

A track electronic apparatus includes multiple converter heads, a converter body, a middle electrode and a function body. The multiple converter heads are respectively corresponding to multiple tracks. The converter body has a first end connecting to one selected converter head. The middle electrode is stored in the converter body. The middle electrode is detachably electrically connected to the head electrode. The function unit is fixed to the converter body. The function unit includes an electronic component connected to the external power source via the middle electrode and the head electrode.

14 Claims, 10 Drawing Sheets

TRACK ELECTRONIC APPARATUS

FIELD

The present application is related to a track electronic apparatus and more particularly related to a track electronic apparatus for adapting different tracks.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Sometimes, light devices are disposed on tracks so that the light devices may be moved along the tracks. However, there are multiple types of tracks and the light devices need to be matched with the tracks to be installed. When the light devices are damaged, the tracks need to be replaced at the same time. This causes inconvenience and raises cost for people to use light devices.

Therefore, it is beneficial to design flexible track light devices that provide more convenience while meeting more requirements.

SUMMARY

In some embodiments, a track electronic apparatus includes multiple converter heads, a converter body, a middle electrode and a function body.

In some embodiments, the multiple converter heads are provided to users so that users may select one converter head fitting to a track that users already disposed on a ceiling or on a wall.

In some other embodiments, the multiple converter heads are integrated on different faces of an integrated housing so that users may select one face to be connected to a first track and, in other cases, select another face to be connected to a second track.

The multiple converter heads are respectively corresponding to multiple tracks. Specifically, the multiple converter heads have structures to respectively fit different types of tracks. The convert heads are connection parts to the tracks.

The multiple tracks are connected to an external power source for routing the external power source to head electrodes of the multiple converter heads when the multiple converter heads are connected to one of the multiple tracks. There is structure connection and electrical connection between the connector head and the track. The track may be disposed with two conductive paths for routing the external power source, e.g. 110V alternating current or direct current power source, to the head electrodes partly exposed to be connected to the conductive paths and partly enclosed by the housing of the converter head for connecting to middle electrodes of the converter body.

The multiple tracks provide sliding tracks for connecting corresponding converter heads to slide along the sliding tracks. Specifically, there are multiple types of structures of the tracks. To fit different types of structures, the converter heads are designed with different protruding structures to fit and to slide along the sliding tracks of different tracks.

The converter body has a first end connecting to one selected converter head. The middle electrode is stored in the converter body. The middle electrode is detachably electrically connected to the head electrode.

The function unit is fixed to the converter body. The function unit includes an electronic component connected to the external power source via the middle electrode and the head electrode. Specifically, the electronic component receives power via the routing of the middle electrode and the head electrode from the external power source.

The function unit may be a spot light, a downlight, a bulb, a speaker, a camera or any other electronic devices providing certain function when the function unit is connected to the external power. In one track, there may be multiple track electronic apparatuses. Some track electronic apparatuses may have the converter head structure as mentioned above while some other track electronic apparatuses are traditional track light devices.

In some embodiments, the multiple connector heads include a first connector head, a second connector head and a third connector head. For example, the first connector head may be corresponding to a Halo track system. The second connector head may be corresponding to a Lightolier track system. The third connector head may be corresponding to a Juno track system.

The first connector head, the second connector head and the third connector head have top heads and top plates. The top heads are protruded from the top plates. The top heads have multiple head electrodes on lateral sides of the top heads for electrically connecting to the external power source of one connected track.

In some embodiments, the first connector head includes two elastic metal clips, a top cover and a head housing. The two elastic metal clips are inserted into slots of the head housing and fixed to the head housing by connecting the top cover to the head housing.

In some embodiments, the electronic component includes a light source module.

In some embodiments, the function unit has a light housing defining a light opening for a light emitted by the light source module to escape. The light housing is movable with respect to the converter body to change a light direction of the light from the light opening.

In some embodiments, the connector body has a rotation structure for manually rotating the function unit with respect to the connector body to change a light direction of the light source module.

In some embodiments, the multiple converter heads have a same bottom housing matching the converter body to be connected to the converter body.

In some embodiments, one of the converter heads has a top plate and a lateral plate. The lateral plate and the top plate are connected with an orthogonal angle. Three sides of the lateral plate are connected to the converter body. Specifically, the lateral plate together with the connector body form an enclosing space when the connector head is assembled with the connector body.

In some embodiments, the track electronic apparatus may also include a guiding track for sliding the converter body to attach to the converter head. The guiding track is parallel to the top plate of the converter head.

In some embodiments, the middle electrode has an elastic clip structure for elastically receiving and clipping the head electrode when the converter body is moved along the guiding track into the connector head.

In some embodiments, the converter body has three middle electrodes. A portion of the connector heads have three head electrodes and a portion of the connector heads have two head electrodes. Specifically, the connector body may have three middle electrodes for L/N/Ground lines, but not every track system provides all the three electrical lines. Some track systems provide only two electrical lines. Therefore, some connector heads have two head electrodes while some connector heads have three head electrodes. But all connector heads fit to be connected to their head electrodes to the middle electrodes.

In some embodiments, the connector body has a buckle structure for buckling the connector body to the connector head. The buckle structure has a pressing unit to be pressed to release attachment of the connector head from the connector body.

In some embodiments, said one of the converter heads further has a lock unit including a manual switch for selectively moving a lock pin to attach to or detach from the corresponding track.

In some embodiments, the converter body has a body connector for detaching connecting to the function unit for replacing different types of the function units.

In some embodiments, the body connector is an Edison socket.

In some embodiments, the body connector is a USB socket.

In other words, to fit different track systems, a corresponding connector head may be selected. In addition, the connector body may have a body connector for fitting different types of function units once the function units have the corresponding connector structures to be connected to the body connector of the connector body.

For example, the body connector may be an Edison socket, which may be attached to different bulbs with the Edison caps.

In some embodiments, there are multiple converter bodies to be selected for attaching to the converter heads to connect different function units. Such design provides even more flexibility. Specifically, users may firstly select a connector head to fit a track system. Then, the users may further select a connector body to fit a different function unit. For example, users may select a connector body with an Edison socket or another connector body with a USB socket for connecting to different function units.

There are various ways for design a connection structure between the connector heads and the connector bodies.

In some embodiments, for example, the connector head has a through hole and a head electrode for connecting to a wire of the external power source. The connector body has a conductive column inserted into the through hole to be electrically connected to the head electrode.

In some embodiments, the conductive column has a bolt head for passing through the through hole and is moved along a sliding groove to contact the head electrode.

In some embodiments, the connector body contains a driver circuit for processing the connected external power source. In other words, the external power source may be 110V alternating current power source and the driver circuit may include a rectifier, a filter and a transformer for converting the 110V alternating current power source to a direct current power source to be supplied to the electronic device of the function unit.

DETAILED DESCRIPTION

Figure 1:
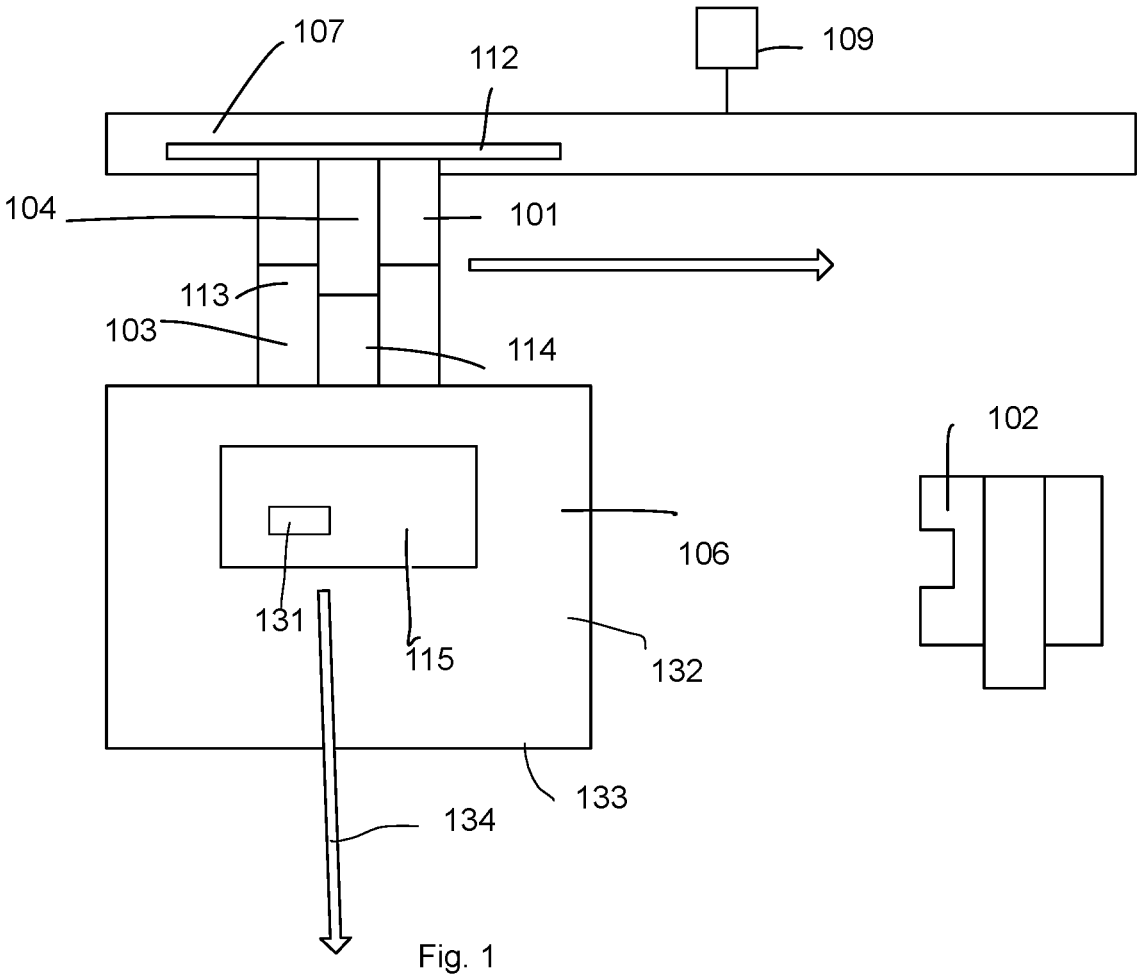
FIG. 1 illustrates a track electronic apparatus embodiment.

In FIG. 1, a track electronic apparatus includes multiple converter heads 101, 102, a head electrode 104, a converter body 103, a middle electrode 105 and a function body 106.

In some embodiments, the multiple converter heads 101, 102 with different housing structures are provided to users so that users may select one converter head fitting to a track that users already disposed on a ceiling or on a wall. For example, the converter head 101 is corresponding to a first tack system while the converter head 102 with a different housing structure as the first converter head 101 is corresponding to a second track system.

Figure 2:
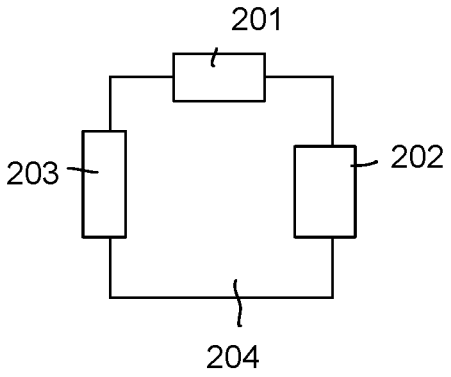
FIG. 2 illustrates a connector head integrated example.

In FIG. 2, the multiple converter heads 201, 202, 203 are integrated on different faces of an integrated housing 204 so that users may select one face to be connected to a first track and, in other cases, select another face to be connected to a second track.

In FIG. 1, the multiple converter heads are respectively corresponding to multiple tracks 107. Specifically, the multiple converter heads have structures to respectively fit different types of tracks. The convert heads are connection parts to the tracks.

The multiple tracks are connected to an external power source 109 for routing electricity of the external power source 109 to head electrodes 104 of the multiple converter heads 101 when the multiple converter heads 101 are connected to one of the multiple tracks 107. There is structure connection and electrical connection between the connector head 101 and the track 107. The track may be disposed with two conductive paths for routing the external power source, e.g. 110V alternating current or direct current power source, to the head electrodes partly exposed to be connected to the conductive paths and partly enclosed by the housing of the converter head for connecting to middle electrodes of the converter body.

The multiple tracks 107 provide sliding tracks 112 for connecting corresponding converter heads 101 to slide along the sliding tracks 112. Specifically, there are multiple types of structures of the tracks. To fit different types of structures, the converter heads are designed with different protruding structures to fit and to slide along the sliding tracks of different tracks.

The converter body 103 has a first end 113 connecting to one selected converter head 101. The middle electrode 114 is stored in the converter body 103. The middle electrode 114 is detachably electrically connected to the head electrode 104.

The function unit 106 is fixed to the converter body 103. The function unit 106 includes an electronic component 115 connected to the external power source 109 via the middle electrode 114 and the head electrode 104. Specifically, the electronic component 115 receives power via the routing of the middle electrode 114 and the head electrode 104 from the external power source 109.

The function unit 106 may be a spot light, a downlight, a bulb, a speaker, a camera or any other electronic devices providing certain function when the function unit is connected to the external power. In one track, there may be multiple track electronic apparatuses. Some track electronic apparatuses may have the converter head structure as mentioned above while some other track electronic apparatuses are traditional track light devices.

In some embodiments, the multiple connector heads include a first connector head, a second connector head and a third connector head. For example, the first connector head may be corresponding to a Halo track system. The second connector head may be corresponding to a Lightolier track system. The third connector head may be corresponding to a Juno track system.

In FIG. 3A, FIG. 3B, FIG. 3C, FIG. 3D, FIG. 3E and FIG. 3F, a connector head for a Halo track system is illustrated.

In FIG. 4A, FIG. 4B, FIG. 4C, FIG. 4D, FIG. 4E, FIG. 4F, a connector head for Juno track system is illustrated.

In FIG. 5A, FIG. 5B, FIG. 5C, FIG. 5D, FIG. 5E, FIG. 5F, a connector head for Lightolier tack system is illustrated.

Figure 6:
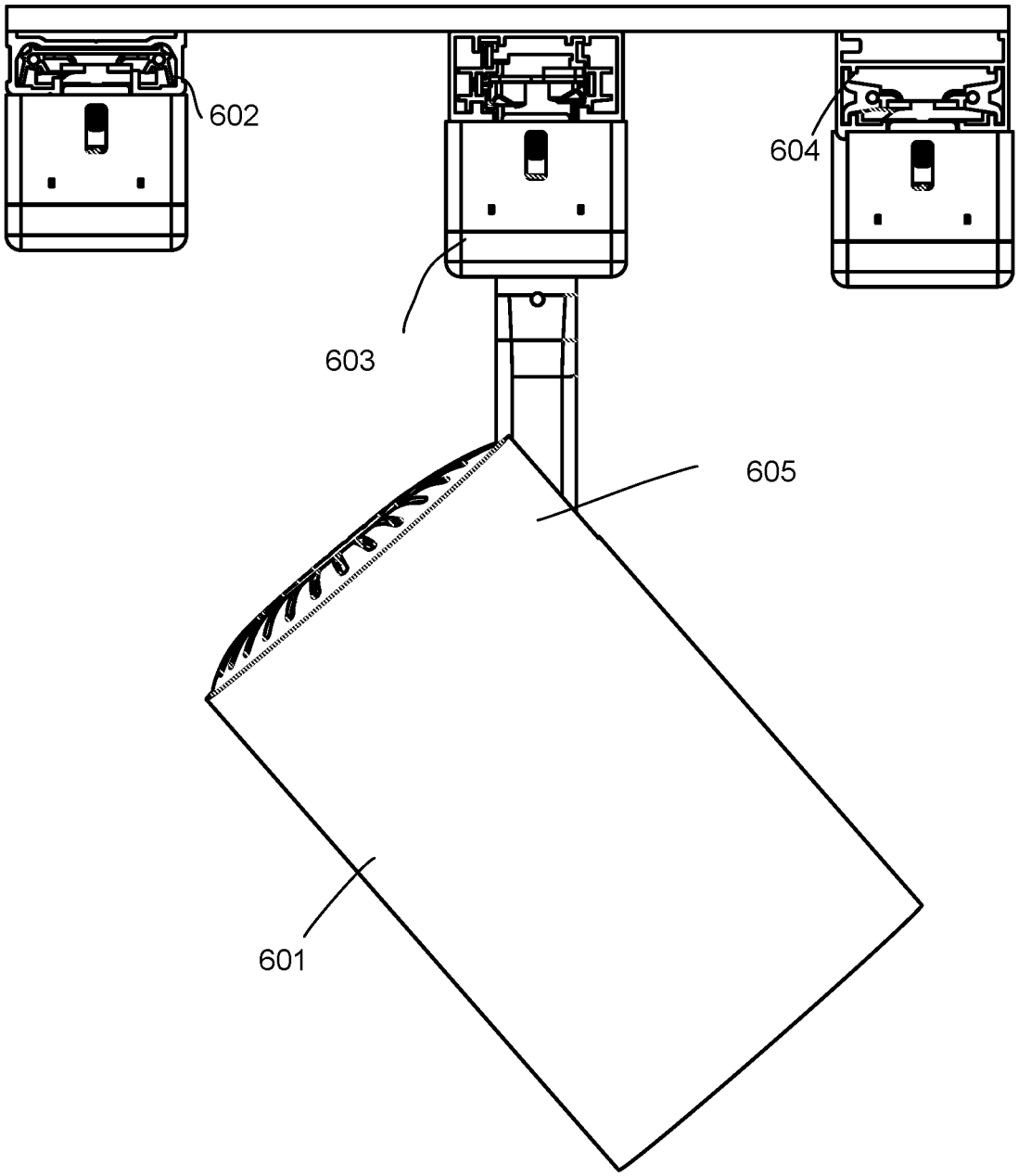
FIG. 6 illustrates a spot light embodiment.

In FIG. 6, a spot light 601, as a function unit, is connected to a connector body 603. The spot light 601 has a rotation structure connecting to the connector body 603 so that the spot light 601 is rotatable to adjust a light direction. In this example, the spot light 601 is fixed to the body connector 603. The same body connector 603 may be detached from the connector head and attached to other connector heads 602, 604.

Figure 3A:
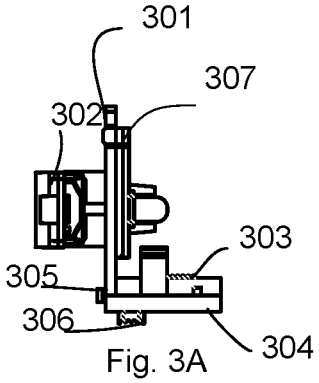
FIG. 3A, FIGS. 3B, 3C, 3D, 3E and 3F illustrate a first connector head embodiment.
Figure 3B:
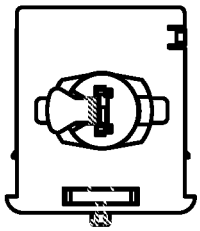
Figure 3C:
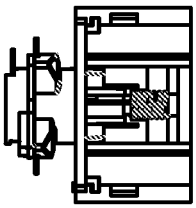
Figure 3D:
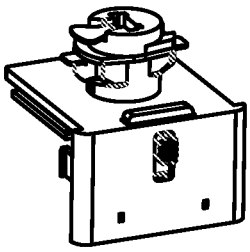

In FIG. 3A, the connector head has a top head 302 and a top plate 301. The top head 302 is protruded from the top plate 301.

The top heads have multiple head electrodes on lateral sides of the top heads for electrically connecting to the external power source of one connected track, as illustrated in FIG. 6.

Figure 7:
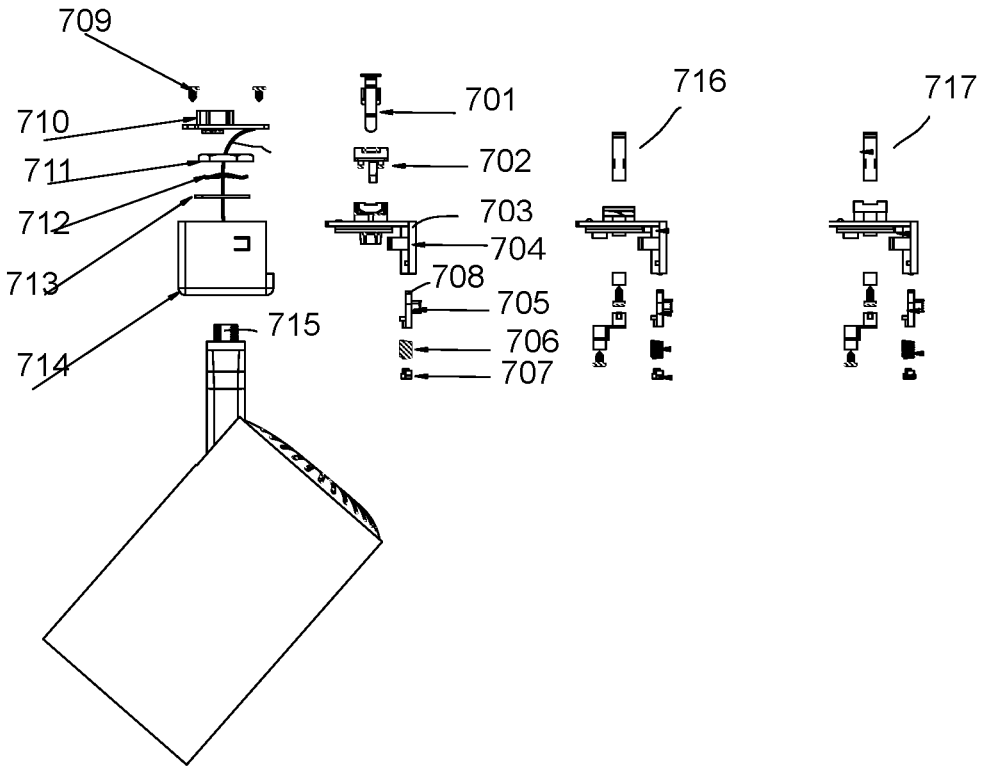
FIG. 7 illustrates an exploded diagram of the example in FIG. 6.

In FIG. 7, the first connector head includes two elastic metal clips 702, a top cover 701 and a head housing 703. The two elastic metal clips 702 are inserted into slots of the head housing 703 and fixed to the head housing 703 by connecting the top cover 701 to the head housing 703.

In FIG. 7, the connector head also has a lateral plate 704. There is positioning unit 705 with a protruding structure 708 extended above the top plate of the head housing 703. There is a spring a block 707 together forming the positioning unit 705 for keeping the connector head in the track.

In FIG. 7, the connector body 714 has screw units 709, 711, a top head 710, a wave washer 712, a blocking unit 713. There are two connector heads 716, 717 illustrated in FIG. 7 showing that they have some identical parts while having other parts different for fitting to different track systems.

In FIG. 1, the electronic component includes a light source module 131. The light source module 131 may include multiple LED modules disposed on a light source plate or an elongated substrate. In some other embodiments, the light source module may further include a lens, a diffusion cover, a reflective cup, a light guide or other components for changing light paths.

In FIG. 1, the function unit 106 has a light housing 132 defining a light opening 133 for a light 134 emitted by the light source module 131 to escape. The light housing 132 is movable with respect to the converter body to change a light direction of the light from the light opening.

In some embodiments, the connector body has a rotation structure for manually rotating the function unit with respect to the connector body to change a light direction of the light source module, as illustrated in FIG. 6.

In some embodiments, the multiple converter heads have a same bottom housing matching the converter body to be connected to the converter body. FIG. 3, FIG. 4 and FIG. 5 show such examples. There are various ways to design the bottom housing for matching different converter bodies.

In FIG. 3A, one of the converter heads has a top plate 301 and a lateral plate 304. The lateral plate 304 and the top plate 301 are connected with an orthogonal angle. Three sides of the lateral plate 304 are connected to the converter body when the connector head is assembled to a connector body. Specifically, the lateral plate together with the connector body form an enclosing space when the connector head is assembled with the connector body.

In some embodiments, the track electronic apparatus may also include a guiding track 307 for sliding the converter body to attach to the converter head. The guiding track 307 is parallel to the top plate 301 of the converter head. The guiding track 307 may be disposed on the converter head or the converter body. To provide the two components with sliding movement, corresponding blocks moving along the guiding track 307 may be disposed on one of the components while the guiding track is placed on the other component.

Figure 8:
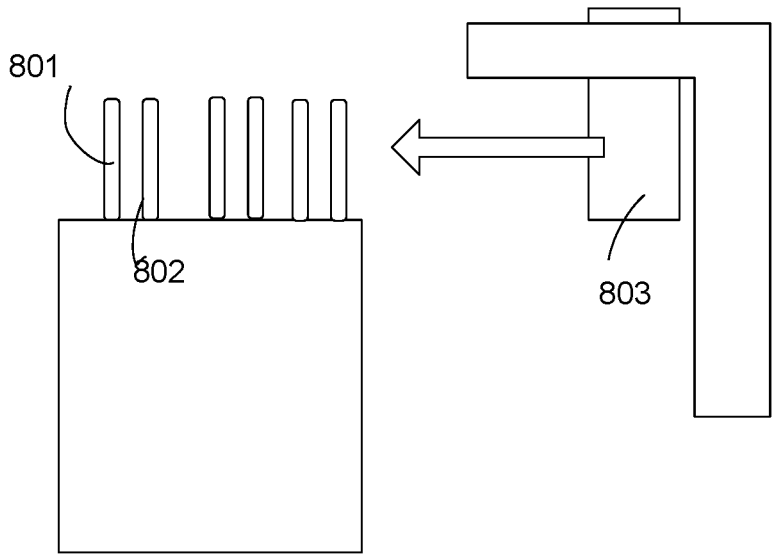
FIG. 8 illustrates an assembling example.

In FIG. 8, the middle electrode 801 has an elastic clip structure 802 for elastically receiving and clipping the head electrode 803 when the converter body is moved along the guiding track into the connector head. In FIG. 8, there are three middle electrodes 801.

In some embodiments, the converter body has three middle electrodes. A portion of the connector heads have three head electrodes and a portion of the connector heads have two head electrodes. Specifically, the connector body may have three middle electrodes for L/N/Ground lines, but not every track system provides all the three electrical lines. Some track systems provide only two electrical lines. Therefore, some connector heads have two head electrodes while some connector heads have three head electrodes. But all connector heads fit to be connected to their head electrodes to the middle electrodes.

Figure 3E:
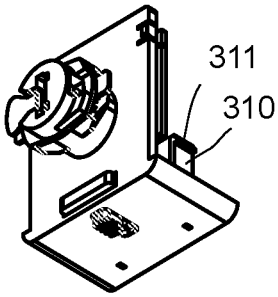
Figure 3F:
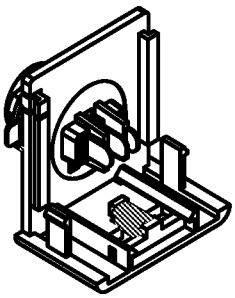
Figure 4A:
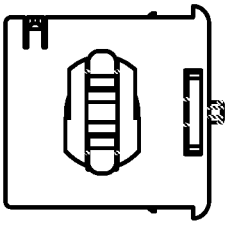
FIG. 4A, FIGS. 4B, 4C, 4D, 4E and 4F illustrate a first connector head embodiment.
Figure 4B:
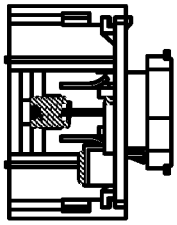
Figure 4C:
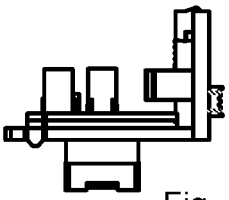
Figure 4D:
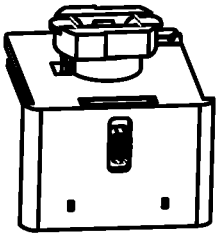
Figure 4E:
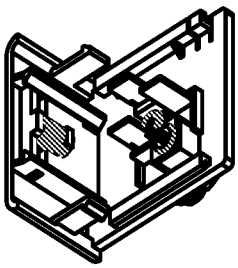
Figure 4F:
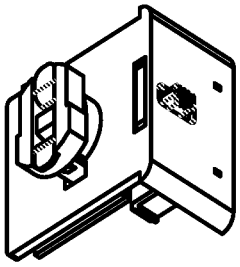
Figure 5A:
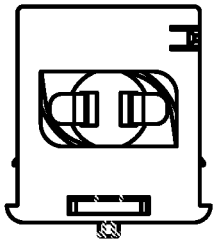
FIG. 5A, FIGS. 5B, 5C, 5D, 5E and 5F illustrate a first connector head embodiment.
Figure 5B:
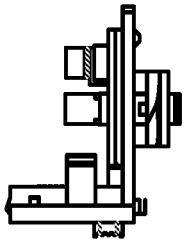
Figure 5C:
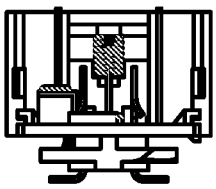
Figure 5D:
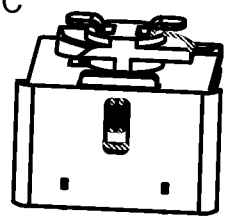
Figure 5E:
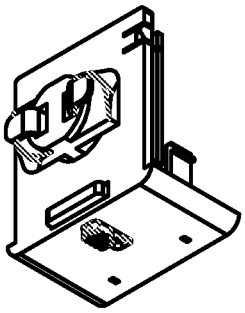
Figure 5F:
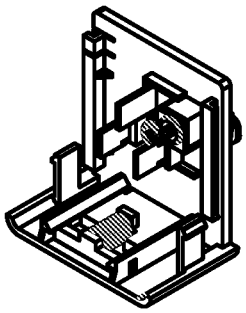

In FIG. 3E, the connector body has a buckle structure, e.g. a buckle slot, for buckling the connector body to a corresponding lock unit 310 the connector head. The buckle structure has a pressing unit 311 to be pressed to release attachment of the connector head from the connector body.

In FIG. 3E, said one of the converter heads further has a lock unit 310 including a manual switch for selectively moving a lock pin to attach to or detach from the corresponding track.

Figure 9:
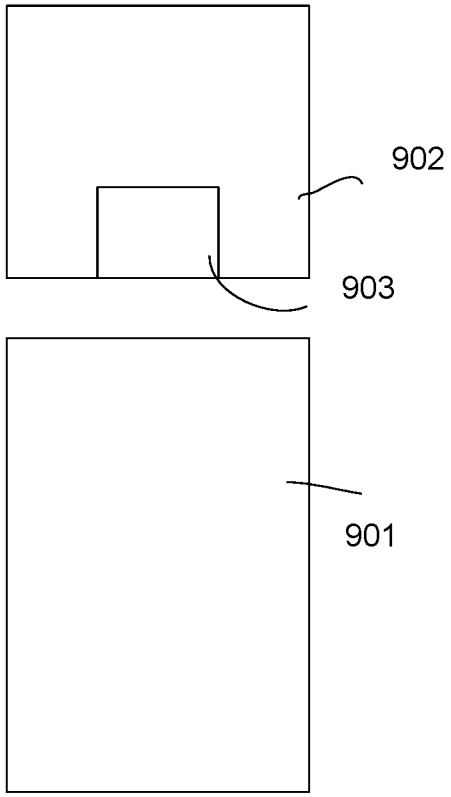
FIG. 9 illustrates a variation example.

In FIG. 9, the converter body 902 has a body connector 903 for detaching connecting to the function unit 901 for replacing different types of the function units.

In some embodiments, the body connector is an Edison socket.

In some embodiments, the body connector is a USB socket.

In other words, to fit different track systems, a corresponding connector head may be selected. In addition, the connector body may have a body connector for fitting different types of function units once the function units have the corresponding connector structures to be connected to the body connector of the connector body.

For example, the body connector may be an Edison socket, which may be attached to different bulbs with the Edison caps.

In some embodiments, there are multiple converter bodies to be selected for attaching to the converter heads to connect different function units. Such design provides even more flexibility. Specifically, users may firstly select a connector head to fit a track system. Then, the users may further select a connector body to fit a different function unit. For example, users may select a connector body with an Edison socket or another connector body with a USB socket for connecting to different function units.

There are various ways for design a connection structure between the connector heads and the connector bodies.

Figure 10:
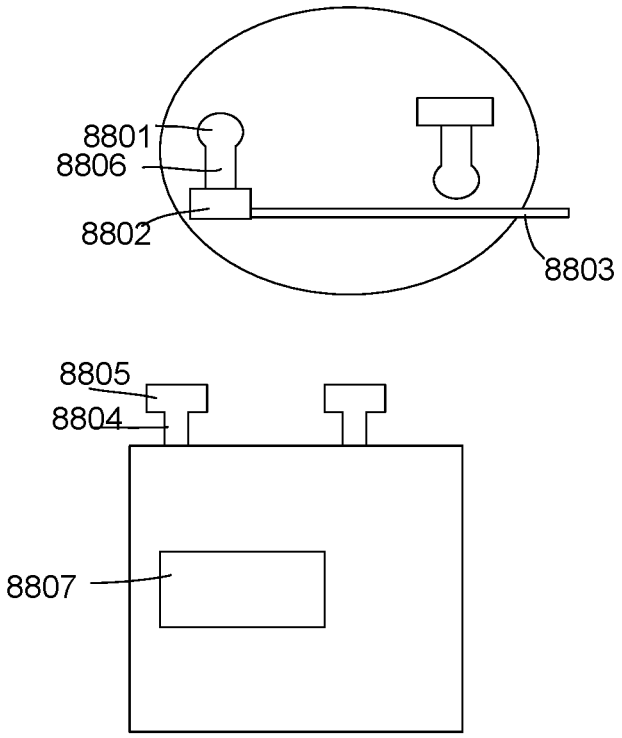
FIG. 10 illustrates another connector example.

In FIG. 10, for example, the connector head has a through hole 8801 and a head electrode 8802 for connecting to an external power source 8803. The connector body has a conductive column 8804 inserted into the through hole 8801 to be electrically connected to the head electrode 8802.

In some embodiments, the conductive column 8804 has a bolt head 8805 for passing through the through hole 8801 and is moved along a sliding groove 8806 to contact the head electrode 8802.

In FIG. 10, the connector body contains a driver circuit 8807 for processing the connected external power source. In other words, the external power source may be 110V alternating current power source and the driver circuit may include a rectifier, a filter and a transformer for converting the 110V alternating current power source to a direct current power source to be supplied to the electronic device of the function unit.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A track electronic apparatus, comprising:

multiple converter heads respectively corresponding to multiple tracks, the multiple tracks connecting to an external power source for routing the external power source to head electrodes of the multiple converter heads when the multiple converter heads being connected to one of the multiple tracks, the multiple tracks providing sliding tracks for connecting corresponding converter heads to slide along the sliding tracks;

a converter body, with a first end connecting to one selected converter head;

a middle electrode stored in the converter body, the middle electrode being detachably electrically connected to the head electrode; and a function unit fixed to the converter body, the function unit comprising an electronic component connected to the external power source via the middle electrode and the head electrode, wherein one of the converter heads has a top plate and a lateral plate, the lateral plate and the top plate are connected with an orthogonal angle, three sides of the lateral plate are connected to the converter body, wherein said one of the converter heads further has a lock unit comprising a manual switch for selectively moving a lock pin to attach to or detach from the corresponding track.

2. The track electronic apparatus of claim 1, wherein the multiple connector heads comprise a first connector head, a second connector head and a third connector head, the first connector head, the second connector head and the third connector head have top heads and top plates, the top heads protrude from the top plates, the top heads have multiple head electrodes on lateral sides of the top heads for electrically connecting to the external power source of one connected track.

3. The track electronic apparatus of claim 2, where the first connector head comprises two elastic metal clips, a top cover and a head housing, the two elastic metal clips are inserted into slots of the head housing and fixed to the head housing by connecting the top cover to the head housing.

4. The track electronic apparatus of claim 1, wherein the electronic component comprises a light source module.

5. The track electronic apparatus of claim 4, wherein the function unit has a light housing defining a light opening for a light emitted by the light source module to escape, the light housing is movable with respect to the converter body to change a light direction of the light from the light opening.

6. The track electronic apparatus of claim 4, wherein the connector body has a rotation structure for manually rotating the function unit with respect to the connector body to change a light direction of the light source module.

7. The track electronic apparatus of claim 1, wherein the multiple converter heads have a same bottom housing matching the converter body to be connected to the converter body.

8. The track electronic apparatus of claim 1, wherein the converter body has three middle electrodes, a portion of the connector heads have three head electrodes and a portion of the connector heads have two head electrodes.

9. The track electronic apparatus of claim 1, wherein the connector body has a buckle structure for buckling the connector body to the connector head, the buckle structure has a pressing unit to be pressed to release attachment of the connector head from the connector body.

10. The track electronic apparatus of claim 1, wherein the converter body has a body connector for detaching connecting to the function unit for replacing different types of the function units.

11. The track electronic apparatus of claim 1, wherein there are multiple converter bodies to be selected for attaching to the converter heads to connect different function units.

12. The track electronic apparatus of claim 1, wherein the connector head has a through hole and a head electrode for connecting to the external power source, the connector body has a conductive column inserted into the through hole to be electrically connected to the head electrode.

13. The track electronic apparatus of claim 12, wherein the conductive column has a bolt head for passing through the through hole and is moved along a sliding groove to contact the head electrode.

14. The track electronic apparatus of claim 1, wherein the connector body contains a driver circuit for processing the connected external power source.

* * * * *